US007526939B2

(12) United States Patent
Cobzaru et al.

(10) Patent No.: US 7,526,939 B2
(45) Date of Patent: May 5, 2009

(54) HIGH PERFORMANCE JAW SYSTEM FOR BLIND FASTENER INSTALLATION

(75) Inventors: Cristinel Ovidiu Cobzaru, Murrieta, CA (US); Izya Lurye, Redondo Beach, CA (US)

(73) Assignee: SPS Technologies, LLC, Jenkintown, PA (US)

( * ) Notice: Subject to any disclaimer, the term of this patent is extended or adjusted under 35 U.S.C. 154(b) by 0 days.

(21) Appl. No.: 12/015,706

(22) Filed: Jan. 17, 2008

(65) Prior Publication Data

US 2008/0184545 A1 Aug. 7, 2008

Related U.S. Application Data

(60) Provisional application No. 60/887,639, filed on Feb. 1, 2007.

(51) Int. Cl.
*B21D 31/00* (2006.01)
*B21J 15/34* (2006.01)

(52) U.S. Cl. ..... 72/391.4; 29/243.523; 29/243.525

(58) Field of Classification Search ..... 29/243.521–243.529; 72/391.4–391.6
See application file for complete search history.

(56) References Cited

U.S. PATENT DOCUMENTS 3,107,806 A * 10/1963 Van Hecke et al. ..... 29/243.522
3,157,305 A * 11/1964 Baugh ..... 29/243.521
3,425,259 A * 2/1969 Baugh ..... 29/243.522
3,605,478 A * 9/1971 Chirco ..... 29/243.529
3,777,540 A * 12/1973 Siebol et al. ..... 29/243.522
3,788,123 A * 1/1974 Gulistan ..... 29/243.529
3,886,782 A * 6/1975 Miyamoto ..... 29/243.528
3,996,784 A * 12/1976 Champoux et al. ..... 29/243.522
4,347,728 A 9/1982 Smith
4,598,572 A * 7/1986 Mondello et al. ..... 29/243.522

* cited by examiner

*Primary Examiner*—David B Jones
(74) *Attorney, Agent, or Firm*—Trexler, Bushnell, Giangiorgi, Blackstone & Marr, Ltd

(57) ABSTRACT

A pulling head having jaws that have a conical angle of at least forty-five degrees, and preferably sixty degrees, relative to a longitudinal axis about which the jaws are arranged. Another pulling head includes an elastic collet that has a plurality of fingers. Each of the fingers includes an internal jaw area, and a back end of the elastic collet preferably contacts a bushing. Preferably, the bushing provides high and reliable push force and also acts as a shock absorber during operation. The fingers of the elastic collet are configured to open and close during tool operation, and are configured to grip a break stem of a fastener such that there is no side loading. The elastic collet is also configured such that the fingers stay accurately centered and positioned, eliminating any possibility of jaw damage caused by the jaws tumbling, being off-center, or being otherwise positioned incorrectly. The elastic collet is positioned somewhat forward in the pulling head, thus increasing the grip length of a break stem. The elastic collet also renders the pulling head easy to assemble.

20 Claims, 16 Drawing Sheets

FIG. 24

| F Axial Force (Lbs) | $2\alpha°$ Included Conical Angle | $\alpha°$ Taper Angle (One Side Only) | $\alpha$(rad) Taper Angle (rad) | R Radial Force (Lbs) |
|---|---|---|---|---|
| 6000 | 90 | 45 | 0.785398 | 3000 |
| 6000 | 60 | 30 | 0.523599 | 5196 |
| 6000 | 36 | 18 | 0.314159 | 9233 |

HIGH PERFORMANCE JAW SYSTEM FOR BLIND FASTENER INSTALLATION

PRIOR APPLICATION (PRIORITY CLAIM)

This application claims the benefit of U.S. Provisional Application Ser. No. 60/887,639, filed Feb. 1, 2007, which is hereby incorporated herein by reference in its entirety.

BACKGROUND OF THE INVENTION

The present invention generally relates to devices for installing fasteners, and more specifically relates to a high performance jaw system for installing fasteners, such as but not limited to blind fasteners.

FIG. 1 provides a cross-sectional view, and FIG. 2 provides an exploded perspective view, of a pulling head 10 which is presently commercially available. The pulling head 10 is configured for engagement with a conventional riveter, such as the G746A power riveter, the G747 power riveter, the G704B riveter, the G30 hand riveter or the G750A hand riveter, each of which is commercially available from Cherry Aerospace.

The pulling head 10 includes a sleeve 12 which is generally cylindrical and has a threaded bore 14 at one of its ends 16 for receiving a nosepiece 18 in a threaded engagement. A collet 20 is disposed in the sleeve 12, and the collet 20 is also generally cylindrical. The collet 20 includes an internally threaded portion 22 which is configured to engage a piston of the riveter in a threaded engagement. Inside the collet 20 sits a set of two or three jaws 24, each of which can be cast from a low grade steel, which is surface hardened or machined from tool steel, and includes teeth 26 which generally match annular serrations of a break stem of the fastener to be installed. The jaws 24 are kept generally together via an o-ring 28 which engages a notch 30 provided on an outside surface 32 of each of the jaws 24.

The front end 34 of each of the jaws 24 is tapered and configured to contact a corresponding angled surface 36 on the nosepiece 18 when the jaws 24 are forward in the collet 20. An external surface 38 of each of the jaws 24 is angled and configured to engage a corresponding angled surface 40 on the inside of the collet 20. In back of the jaws 24 is a jaw follower 42. Specifically, the back end 44 of each of the jaws 24 provides an angled surface 46 which is configured to engage a corresponding angled surface 48 on the jaw follower 42. The jaw follower 42 is generally cylindrical and engages an end 50 of a compression spring 52. An opposite end 54 of the compression spring 52 engages a shoulder 56 which is provided proximate an end 58 of a sleeve 60. In addition to the angled surface 48 on the jaw follower 42, the jaw follower 42 includes a bore 62. The sleeve 60 also includes a longitudinal bore 64.

The pulling head 10 shown in FIGS. 1 and 2 is configured such that the jaws 24 rest on the jaw follower 42 and are kept in position with the assistance of the compression spring 52. The jaws 24 are relatively small and stubby and are unable to function unless they are pushed forward with significant force by the jaw follower 42 (viz-a-viz the compression spring 52).

The pulling head 10 shown in FIGS. 1 and 2 works relatively well for fasteners requiring lower installation loads, with break stems having serrations that have a relatively fine pitch, when the load per tooth and the installation shock is low. However, for higher loads and installation shocks (such as is required for installing steel blind bolts), the pulling head 10 shown in FIGS. 1 and 2 has a low life and is not very reliable.

Some of the factors contributing to the pulling head 10 shown in FIGS. 1 and 2 having a low tool life include: high load per jaw tooth due to so few teeth 26 being in engagement with the break stem of the fastener; low life of the spring 52 used to keep the jaws 24 in position and to close them during operation, causing the jaws to mis-align or tumble; the loose jaws are difficult to assemble, and they are prone to mis-aligning and tumbling during operation, the jaws are far away from the stem to be grabbed, creating insurmountable jaw engagement issues that cause installation failures and frequent jaw breakages.

As mentioned above, during operation the compression spring 52 behind the jaw follower 42 takes a set due to very high shock loads and axial forces weakening the push on the jaws 24. While a weaker spring causes instability of the jaws causing them to possibly tumble and break, increasing the spring force tends to cause the jaw follower to fail.

The jaw life expectation of the pulling head 10 shown in FIGS. 1 and 2 is typically a few hundred installations. In a high volume production environment, this is unacceptable. The jaws tend to fracture on the conical area, and it has been found that changing to tougher or stronger materials seems to have little impact on this type of failure.

U.S. Pat. No. 4,347,728 discloses a jaw system which provides three small jaws which are vulcanized on a rubber tube. The section of the jaws is relatively large, in order to provide stiffness. Although the pulling head design disclosed in the '728 patent partially solves the jaw alignment problem and makes the assembly operation easier, certain issues remain unresolved making the design an incremental improvement at best. For example, the alignment of the serrations of the jaws with those of the break stem still remain an issue. The three jaws are cast, and the overall length cannot be accurately controlled. Therefore, slight variations in the jaw length will position the teeth of the jaws off from each other, causing uneven loading of the jaws. Also, since the jaw length and number of serrations in engagement with the break stem is too short for the extremely high loads and shocks, jaw life is still relatively low (and not significantly different from that of the pulling head shown in FIGS. 1 and 2). Furthermore, due to the design being very size specific, the jaw radial expansion is constrained. Additionally, the rubber tube is easily damaged by the stems as they eject, due to their moving at high velocity. Moreover, because of the configuration of the jaws, they have to be relatively far from the active area of the installation, so grip capability, stem length, and jaw engagement are typically insurmountable problems. Finally, the bulkiness of the jaws and the length of the rubber tube lead to larger tools, and in the aerospace industry tool compactness is critical.

OBJECTS AND SUMMARY OF THE INVENTION

An object of an embodiment of the present invention is to provide a pulling head which solves at least some of the problems of the prior art.

Another object of an embodiment of the present invention is to provide a pulling head which has an increased jaw life.

Still another object of an embodiment of the present invention is to provide a pulling head which is configured such that, in operation, the jaws do not tend to tumble or mis-match.

Briefly, and in accordance with the foregoing, an embodiment of the present invention provides a pulling head which is configured for engagement with a piston of a riveter and configured to grip and pull a stem of a fastener. The pulling head includes a sleeve, a nosepiece engaged with an end of the sleeve, a collet inside the sleeve and engageable with the piston, a plurality of jaws which are inside the collet and which are configured for engaging and pulling on the stem. The jaws are arranged about a longitudinal axis, and each of the jaws has an angled surface which contacts an internal surface of the collet and which is at least fifty degrees, and preferably about sixty degrees, relative to the longitudinal axis about which the jaws are arranged.

Another embodiment of the present invention provides a pulling head which includes a sleeve, a nosepiece engaged with an end of the sleeve, a first collet inside the sleeve, and a second, elastic collet inside the first collet. The elastic collet has a plurality of fingers, between each of which is a slot. Each of the fingers includes an internal jaw area, and a back end of the elastic collet preferably contacts a bushing inside the first collet. The bushing also contacts a piston of a riveter when the piston is engaged with the first collet. As such, the bushing is located between the piston of the riveter and the elastic collet. Preferably, the bushing provides high and reliable push force and also acts as a shock absorber during operation. The fingers of the elastic collet are configured to open and close during tool operation, and are configured to grip a break stem of a fastener during installation such that there is no side loading. The elastic collet is also configured such that the fingers stay accurately centered and positioned, eliminating any possibility of jaw damage caused by the jaws tumbling, being off-center, or being otherwise positioned incorrectly. The elastic collet is positioned somewhat forward in the pulling head, thus increasing the grip length of a break stem. The elastic collet also renders the pulling head easy to assemble.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which:

FIG. 24 provides a table which shows the radial force which is experienced at different conical angles.

DETAILED DESCRIPTION OF THE ILLUSTRATED EMBODIMENTS

Figure 1:
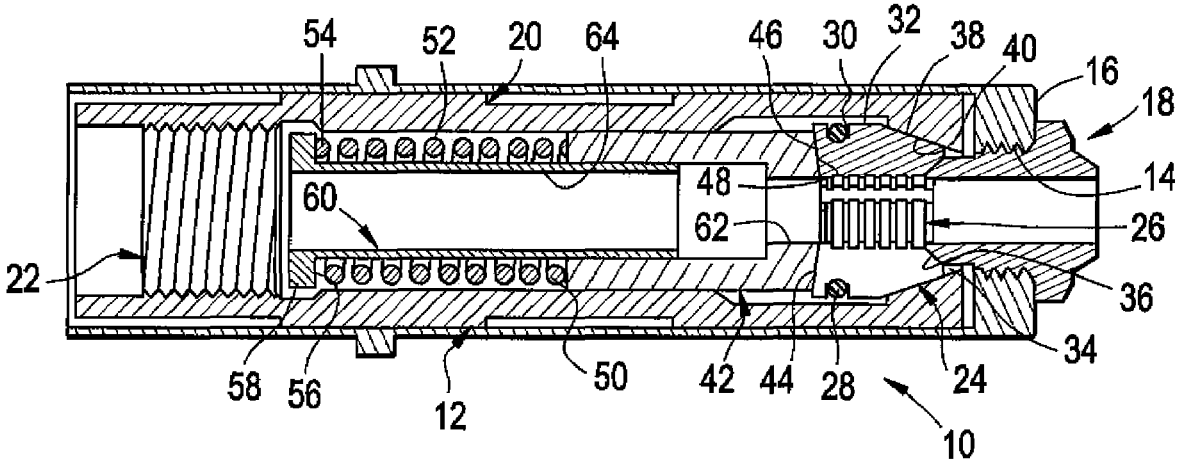
FIG. 1 PRIOR ART
FIG. 1 is a cross-sectional view of a pulling head which is presently commercially available.

While this invention may be susceptible to embodiment in different forms, there are shown in the drawings and will be described herein in detail, specific embodiments with the understanding that the present disclosure is to be considered an exemplification of the principles of the invention, and is not intended to limit the invention to that as illustrated.

Figure 2:
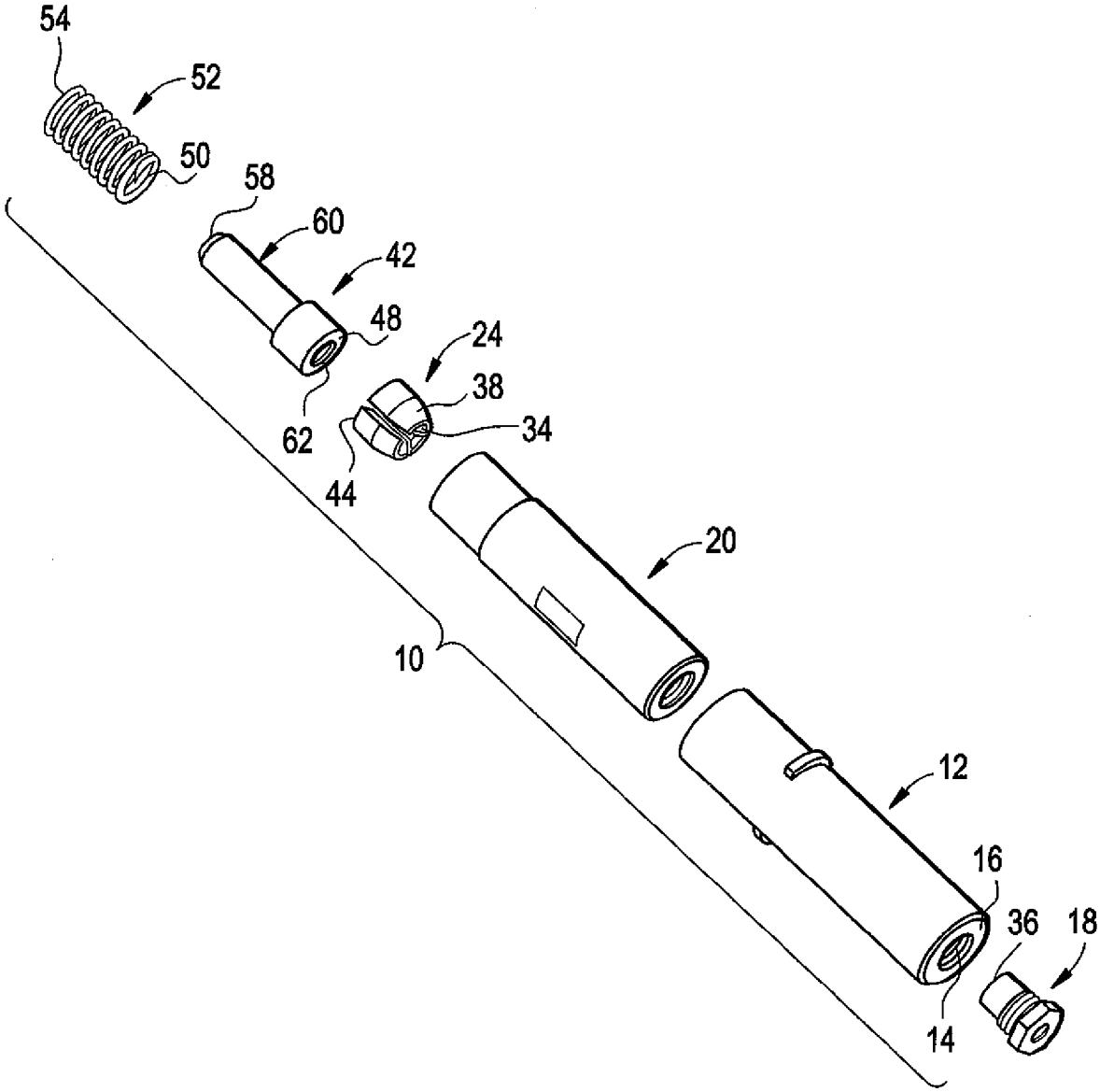
FIG. 2 PRIOR ART
FIG. 2 is an exploded perspective view of the pulling head shown in FIG. 1.
Figure 3:
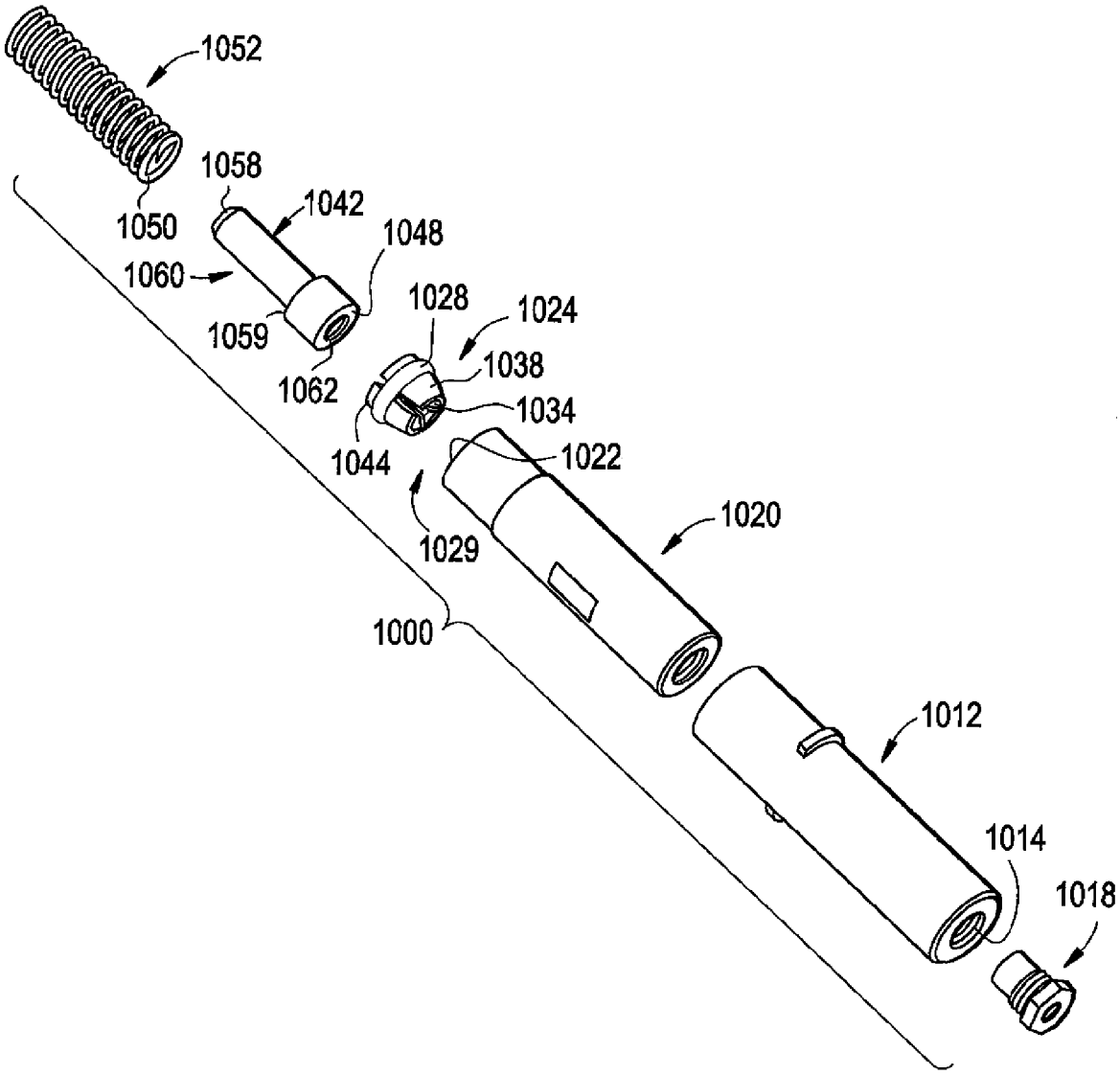
FIG. 3 is an exploded perspective view of a pulling head which is in accordance with an embodiment of the present invention.

FIG. 3 illustrates a pulling head 1000 which is in accordance with a preferred embodiment of the present invention. The pulling head 1000 is configured such that it is engageable with a conventional riveter, such as the G746A power riveter, the G747 power riveter, the G704B riveter, the G30 hand riveter or the G750A hand riveter, each of which is commercially available from Cherry Aerospace. The pulling head 1000 is configured to grip and pull on a break stem of a fastener, and is very much like the pulling head 10 shown in FIGS. 1 and 2 and described hereinabove. Much like the pulling head 10 shown in FIGS. 1 and 2 and described hereinabove, the pulling head 1000 includes a sleeve 1012 which is generally cylindrical and has a threaded bore 1014 at one of its ends 1016 for receiving a nosepiece 1018 in a threaded engagement. A collet 1020 is disposed in the sleeve 1012, and the collet 1020 is also generally cylindrical. The collet 1020 includes an internally threaded portion 1022 which is configured to engage a piston of the riveter in a threaded engagement. Inside the collet 1020 sits a set three jaws 1024, each of which can be cast from a low grade steel, which is surface hardened or machined from tool steel, and includes teeth 1026 which generally match annular serrations of a break stem of the fastener to be installed. The jaws 1024 are kept generally together via an o-ring or spring ring 1028 (see also FIG. 4) which engages a notch 1030 (see FIG. 6) provided on an outside surface 1032 of each of the jaws 1024. As such, the jaws 1024 and o-ring 1028 form a jaw assembly 1029 which is arranged about a longitudinal axis 1031.

Figure 7:
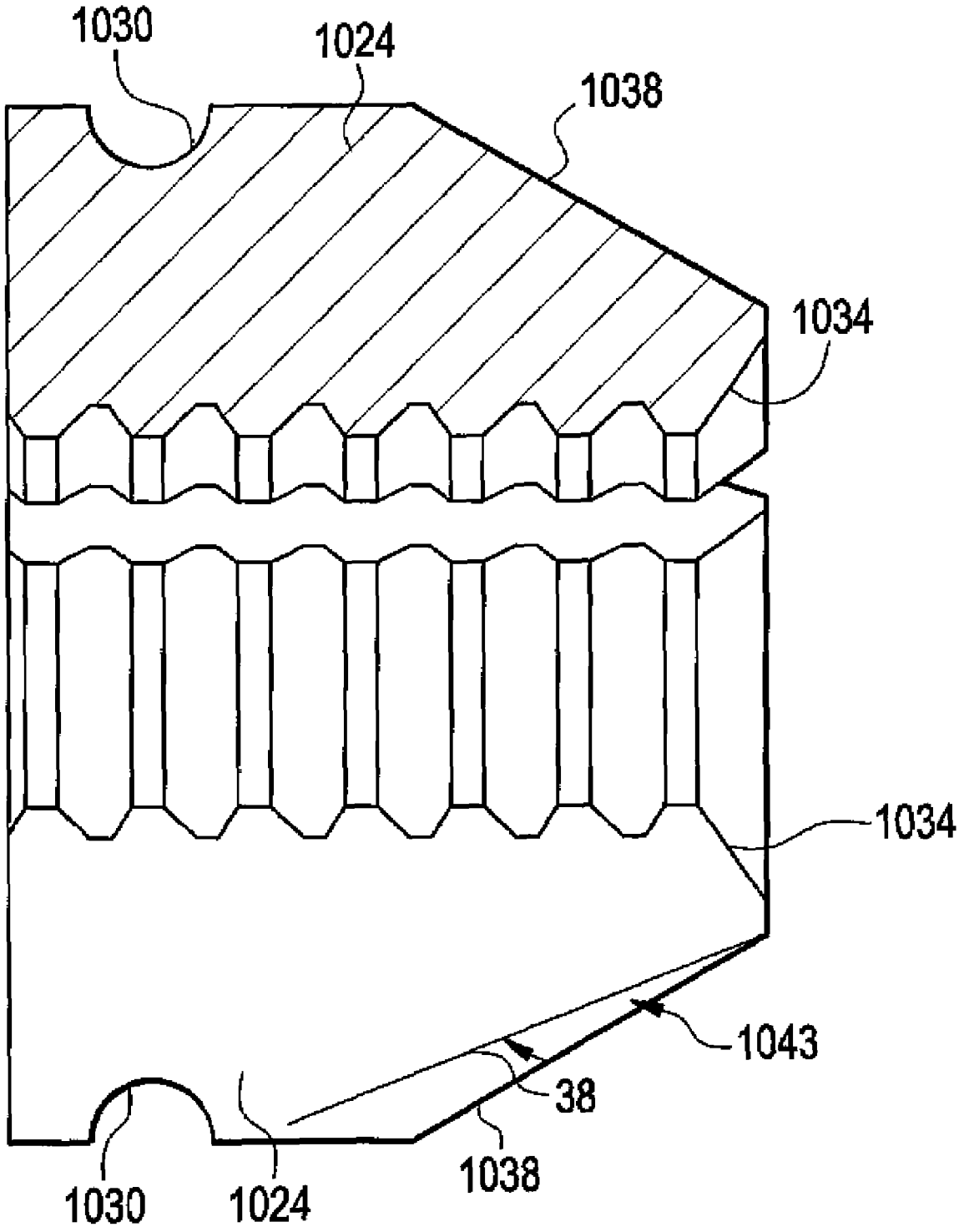
FIG. 7 is a partial cross-sectional view of one of the jaws, with the other jaws being identical.

As shown in FIG. 7, the front end 1034 of each of the jaws 1024 is tapered and configured to contact a corresponding angled surface 1036 (see FIG. 8) on the nosepiece 1018 when the jaws 1024 are forward in the collet 1020. An external surface 1038 of each of the jaws 1024 is angled and configured to engage a corresponding angled surface 1040 (see FIG. 8) on the inside of the collet 1020. In back of the jaws 1024 is a jaw follower 1042. Much like with the pulling head 10, the back end 1044 of each of the jaws 1024 of pulling head 1000 may provide an angled surface which is configured to engage a corresponding angled surface 1048 on the jaw follower 1042. The jaw follower 1042 is generally cylindrical and has a shoulder 1059 which engages an end 1050 of a compression spring 1052. In addition to the angled surface 1048 on the jaw follower 1042, the jaw follower 1042 includes a bore 1062.

The pulling head 1000 shown in FIG. 3 is configured such that the jaws 1024 rest on the jaw follower 1042 and are kept in position with the assistance of the compression spring 1052. The jaws 1024 are relatively small and stubby and are unable to function unless they are pushed forward with significant force by the jaw follower 1042 (via the compression spring 1052).

Figure 4:
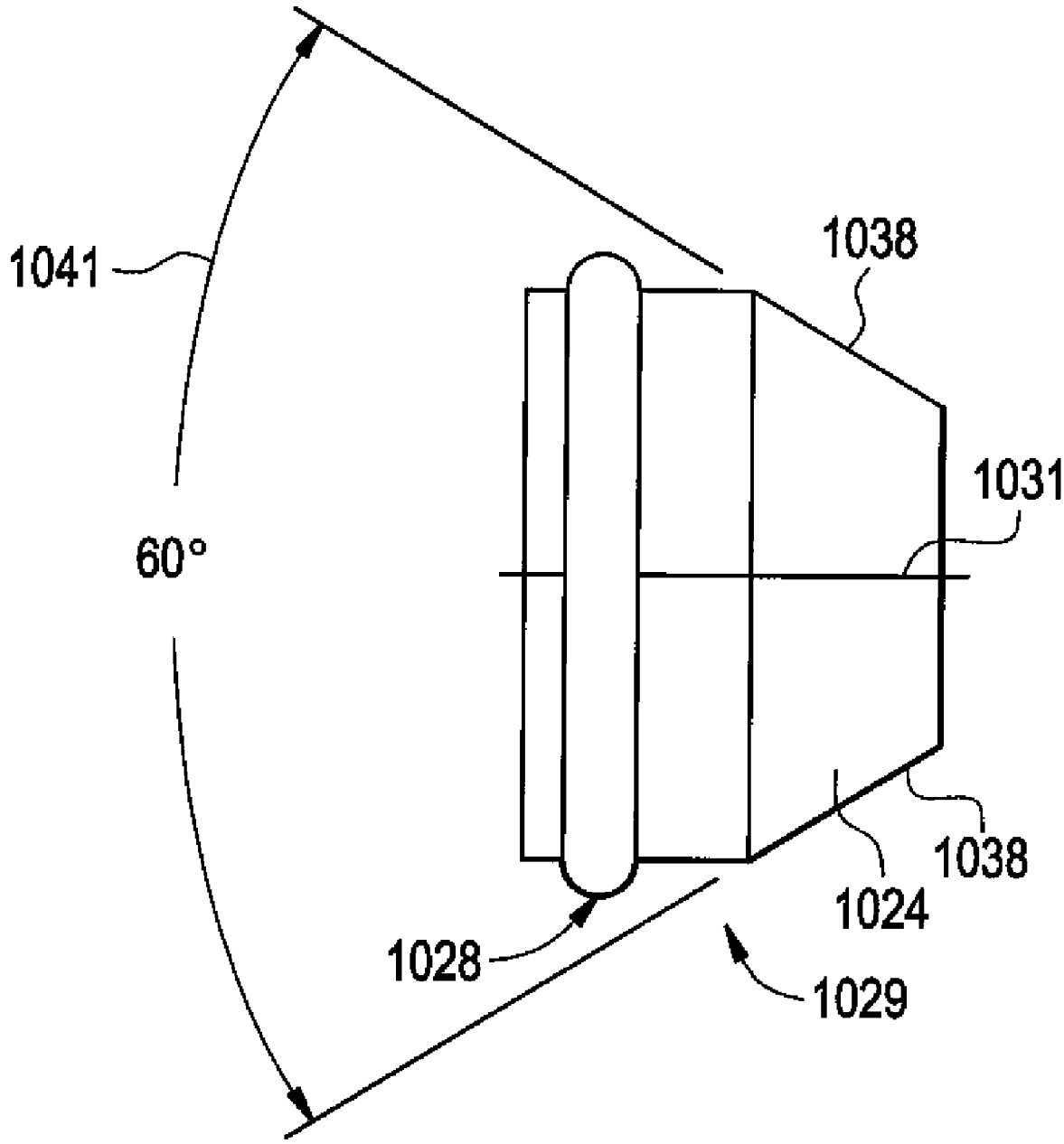
FIG. 4 is a side view of the jaw assembly, shown isolated from the reminder of the pulling head for clarity, showing a preferred angle of an angled surface of the jaws.
Figure 5:
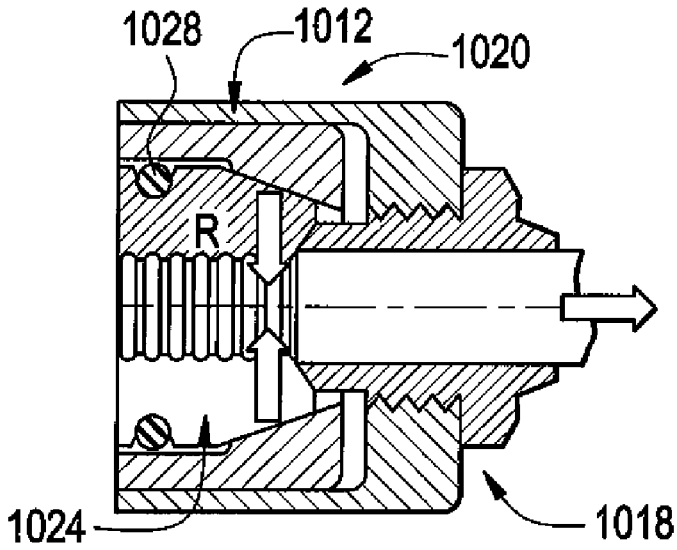
FIG. 5 is a cross-sectional view of a front portion of the pulling head shown in FIG. 3; a pulling head which is in accordance with an embodiment of the present invention
Figure 6:
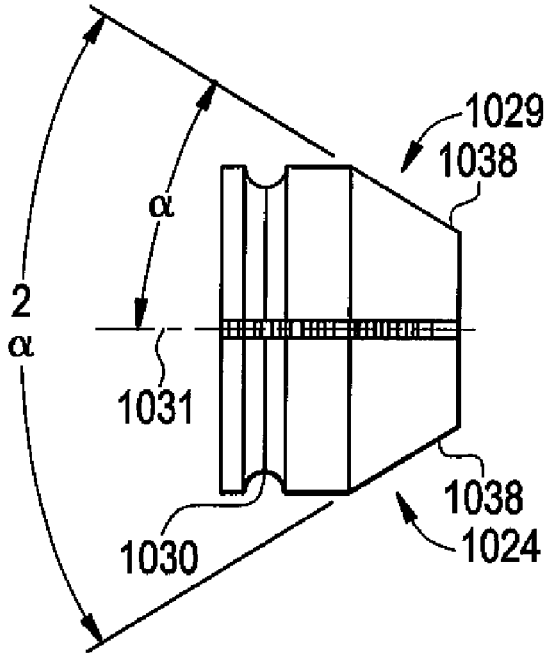
FIG. 6 is another side view of the jaw assembly, with an o-ring omitted.

All this is similar to the pulling head 10 described hereinabove. However, the area in which the pulling head 1000 differs from the pulling head 10 is significant. With the pulling head 1000, the angled surface 1038 of each of the jaws 1024 is angled such that it forms at least a forty-five degree angle with regard to the longitudinal axis 1031 about which the jaw assembly 1029 is arranged. As shown in FIG. 4, preferably this angle (indicated with reference numeral 1041 in FIG. 4) is about 60 degrees as this has been found to provide very good results. Specifically, it has been found that starting at a sixty degree conical angle, the radial force produced by the installation load is de-multiplied. During operation, the installation forces and shocks are transferred to the jaws 24, 1024, resulting in high radial loads "R" as shown in FIG. 5. The radial load adds tremendous compressive stress on the conical surface 38, 1038 of the jaws, which is by design weaker. When the angle 1041 is thirty-six degrees, as is the case with the pulling head 10, the jaws 24 fatigue relatively fast under these loads and fracture at this area 1043 as shown in FIG. 7. The rate of load transfer is controlled by the conical angle of the jaws (i.e., angle 1041 in FIG. 4). For example, at an angle of sixty degrees (i.e., when angle 2-alpha in FIG. 6 is sixty degrees and angle alpha in FIG. 6 is thirty degrees) a 6000 pounds installation load causes about 5200 pounds of radial load, pushing the jaws into the stem to be installed. By comparison, when the conical angle is thirty-six degrees (i.e., when angle 2-alpha in FIG. 6 is thirty-six degrees and angle alpha in FIG. 6 is eighteen degrees)—which is the conical angle of the jaws 24 of pulling head 10, the same installation load produces close to 10,000 pounds (doubling the operating stresses). At a ninety degree conical angle, an axial load of 6000 pounds causes a radial load of 3000 pounds. FIG. 24 provides a table which shows the radial force which is experienced at different conical angles. As seen, larger conical angles are more effective in reducing hoop stress. The catch is to still have enough radial load for effective jaw grip and to prevent slippage. Sixty degrees is a good angle because it is effective in reducing stress at high installation loads, but still provides enough radial force at low installation loads not to cause stem slippage. The larger angle also increases the section thickness at the most stressed area of the jaw (the conical surface) significantly, increasing jaw strength and impact capability.

While a sixty degree angle has been described as being beneficial, it should be understood that angles smaller or larger than the sixty degrees, such as a 50, 55 59, 61, 65, 70 degree angle can be used, for example. Preferably, the angle is at least forty-five degrees. The low compressive forces allow the addition of a spring groove 1030 without impacting the jaw life. The jaws 1024 can be pre-assembled together with a spring element 1028 that keeps them centered. This makes jaw assembly much easier, and does not allow tumbling of the jaws during operation even when the spring 1052 is not fully functional.

By increasing the conical angle (such as to at least forty-five degrees) not only lowers the compressive loads, but also provides that the conical area of the jaws is stubbier at the typical failure section, increasing the jaw strength and capability to withstand shock loads and fatigue. The lower transfer rate of the installation loads into a radial component also reduces the transfer of the tremendous shock developed during installation. This makes it possible to add a spring groove for pre-assembling the jaws without any impact on the jaw life. In the past, this feature caused jaw failure.

By increasing the conical angle, the internal conical surface 1040 (see FIG. 8) of the collet 1020 can also be provided as being stubbier, and therefore stronger in the force transfer area. Due to reducing the amount of stress on the collet 1020 during operation, it may be possible that the collet 1020 may be made of a cheaper, lower strength material than the collet 20 of the pulling head 10. Regardless, with the reduced operating stresses, the endurance of the collet 1020 is improved, providing a better overall pulling head design.

Figure 8:
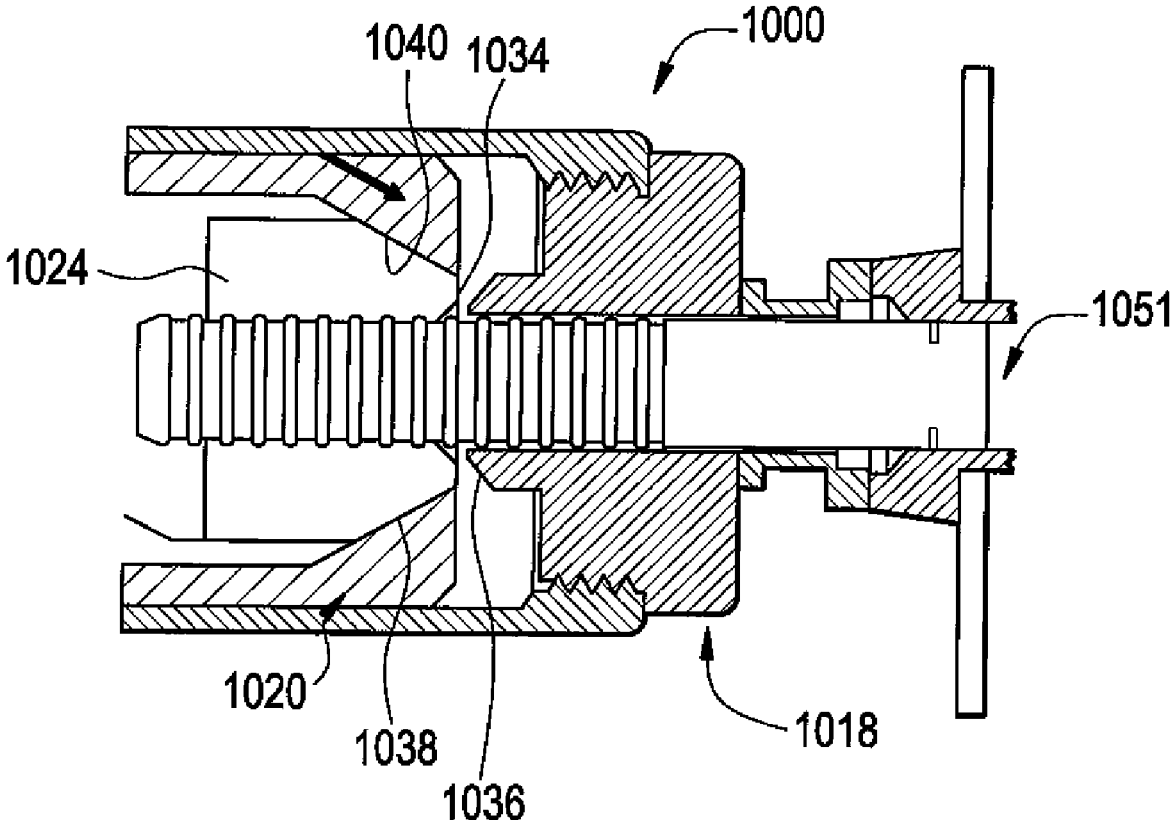
FIGS. 8-10 are cross-sectional view of a front-portion of the pulling head, showing a fastener being installed (but only showing a portion of the fastener and workpiece—see FIGS. 19-23 to view an example entire workpiece and fastener structure)
Figure 9:
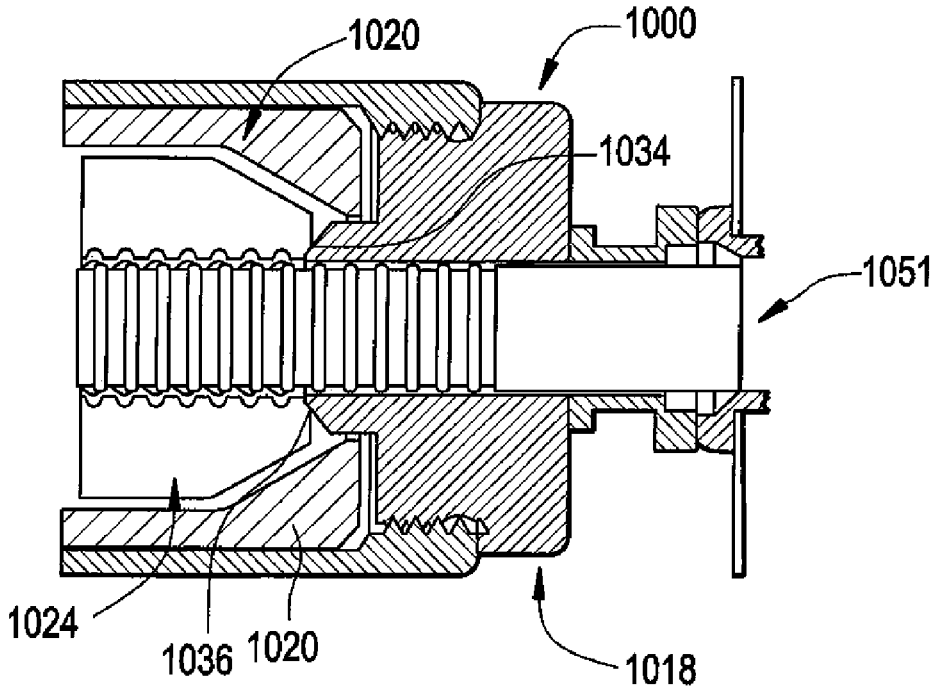
Figure 10:
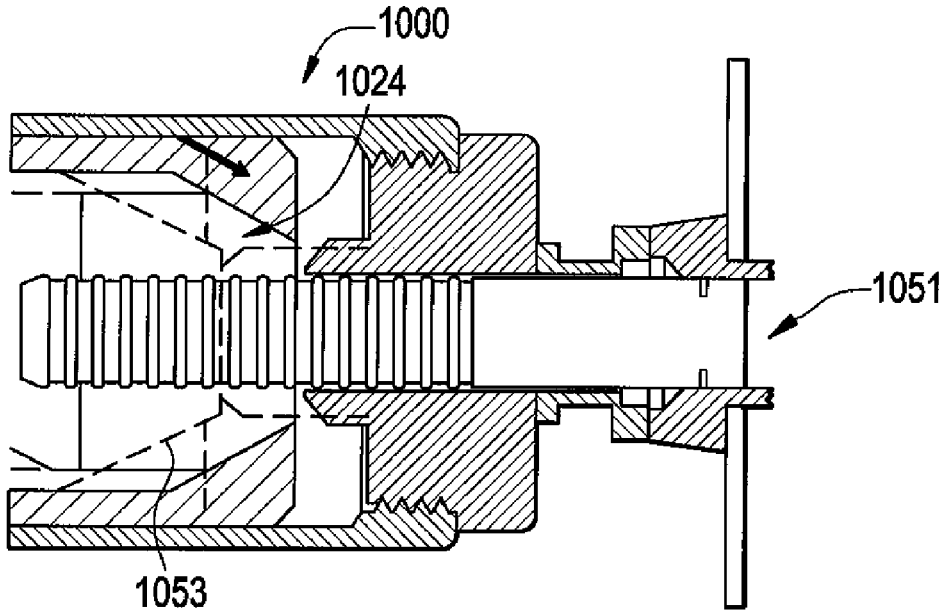

As shown in FIGS. 8-10 (it should be noted that FIGS. 8-10 only show a portion of the fastener and workpiece—see FIGS. 18-22 to view an example entire workpiece and fastener structure), the increased conical angle of the jaws reduces considerably the travel necessary for the jaws 1024 to come in and out of engagement with the collet 1020 that forces them to close. This means less lag time (time to close the jaws on the stem 1051 to be installed). It also makes it possible for the jaws 1024 to be physically closer to the stem 1051 to be installed, therefore increasing gripping the stem much closer to the nosepiece 1018. In FIG. 10, lines 1053 show the position of the jaws 24 of the pulling head 10 compared to the jaws 1024 of the pulling head 1000. This is a major improvement in that grip capability is increased and installation issues are eliminated which are caused by shorter stems, currently a major cause for failure. The closer the jaws are to the stem to be installed, and the more compact the jaws are, allows for a more compact pulling head design. Additionally, there is more room behind the jaws for a longer spring 1052 and the decreased travel of the jaws 1024 induces less compression. Less compression, distributed over an increased number of coils results in reduced stresses in the spring, increasing its life.

Figure 11:
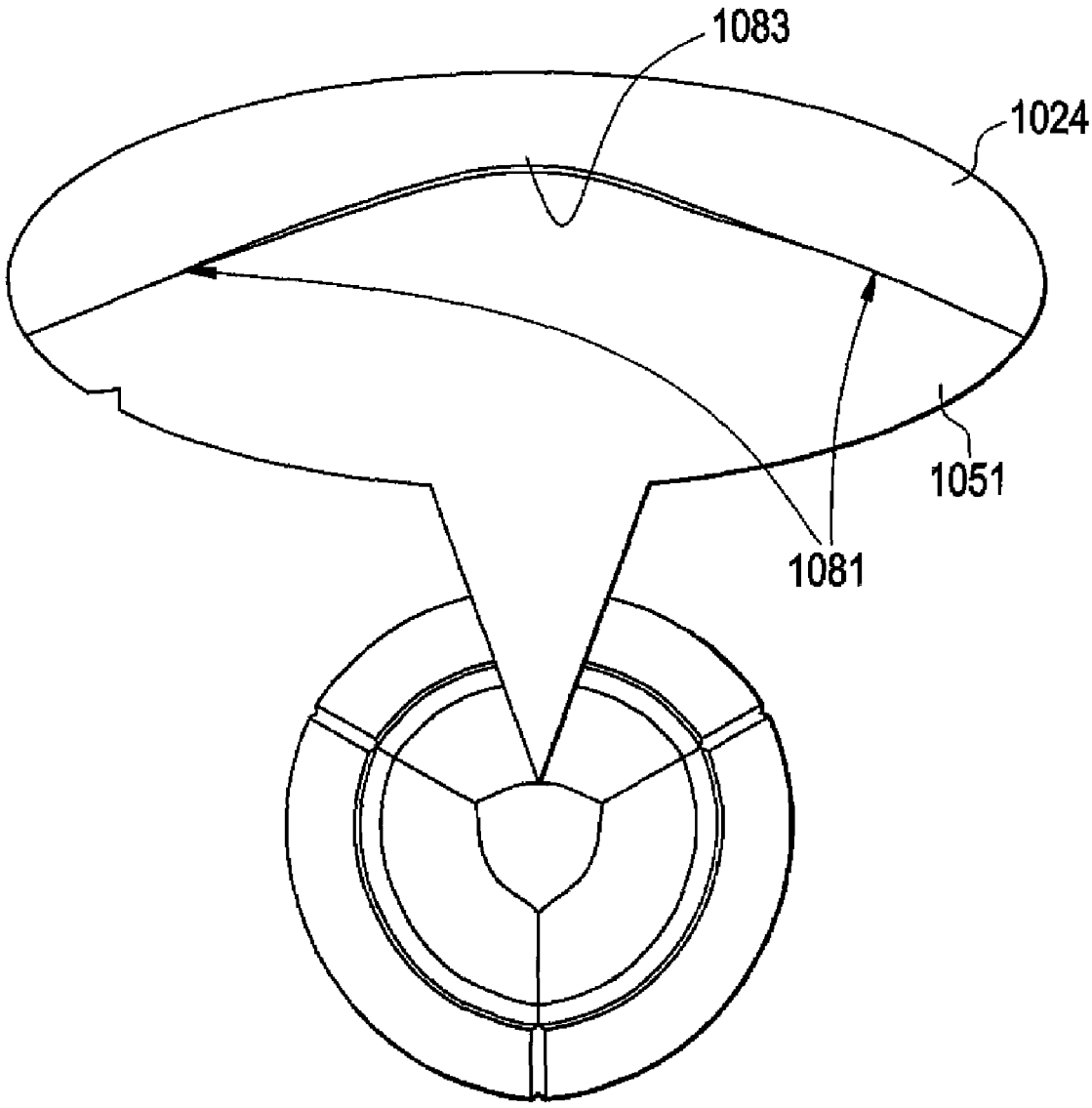
FIG. 11 is a transverse cross-sectional view (i.e., perpendicular to a longitudinal axis of the jaws) of the jaw assembly, showing that the jaws have straight serrated segments for increased jaw contact with a stem.

As discussed above, the jaws 1024 are preferably either manufactured or cast out of a low alloy steel and case hardened, in order to optimize strength and toughness. If the jaws are cast, preferably the shape of the internal teeth (i.e., serrations) are as shown in FIG. 11 (which shows the jaws in transverse cross-section—i.e., perpendicular to a longitudinal axis of the jaws), wherein the teeth are comprised of two straight segments 1081 having a generous fillet 1083 therebetween. This design doubles the number of points of contact between the stem 1051 and the jaws 1024, making the jaws 1024 work well for any diameter stem decreasing the operation stresses significantly.

Figure 12:
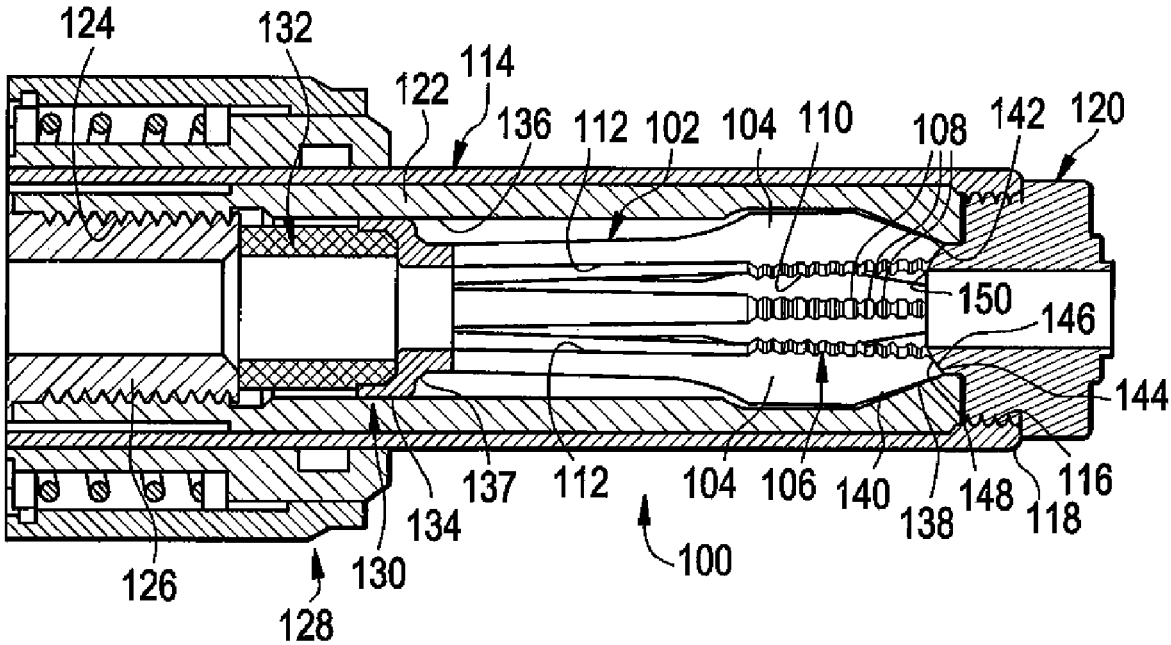
FIG. 12 is a cross-section view of a pulling head which is in accordance with another embodiment of the present invention.

FIG. 12 illustrates a pulling head 100 which is in accordance with an alternative embodiment of the present invention. The pulling head 100 is configured such that it is engageable with a conventional riveter, such as the G746A power riveter, the G747 power riveter, the G704B riveter, the G30 hand riveter or the G750A hand riveter, each of which is commercially available from Cherry Aerospace. The pulling head 100 is configured to grip and pull on a break stem of a fastener and, to that end, includes an elastic collet 102 which has a plurality of fingers 104, and each of the fingers 104 includes an internal jaw area 106 (see FIG. 14). The internal jaw area 106 includes annular grooves 108 (i.e., teeth) which are machined into the internal surface 110 of the fingers 104, and are configured to engage corresponding serrations on the break stem of the fastener which is to be installed using the pulling head 100. Preferably, the internal jaw area 106 of the fingers 104 is configured such that the teeth 108 of each of the fingers 104 are perfectly matched to share the load during operation, thereby providing no risk of side loading. The internal jaw area 106 of the fingers 104 is also configured such that the length of contact with the break stem is much longer than that of the pulling head 10 shown in FIGS. 1 and 2 (for example, 30 percent greater on 8 diameter blind bolts).

Figure 13:
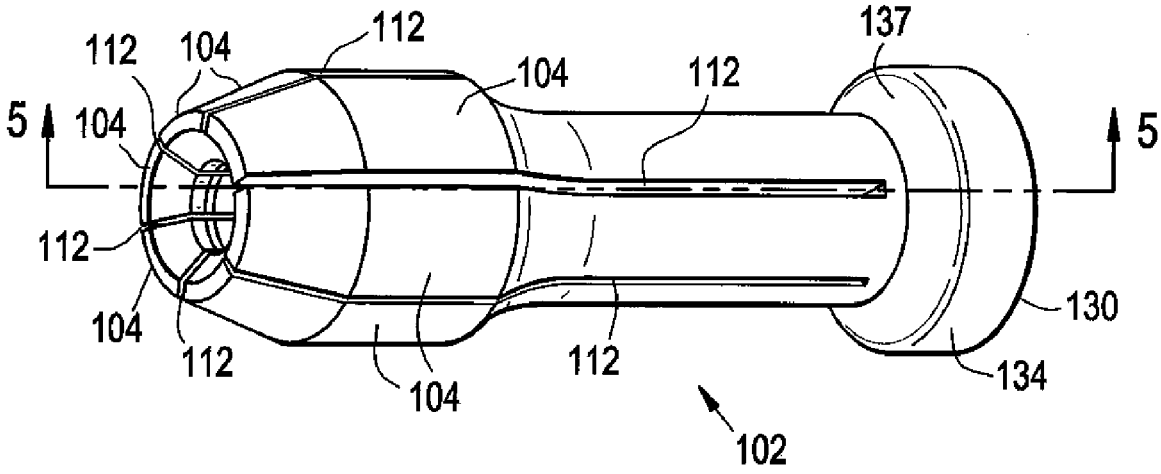
FIG. 13 is a perspective view of an elastic collet component of the pulling head shown in FIG. 12.

Between each of the fingers 104 is a radial slot 112 (see FIG. 13). The fingers 104 are configured to open and close during tool operation, and are configured to grip the break stem of a fastener during installation such that there is no side loading. The elastic collet 102 is also configured such that the fingers 104 stay accurately centered and positioned, eliminating any possibility of jaw damage caused by the jaws tumbling, being off-center, or being otherwise positioned incorrectly. The elastic collet 102 is positioned somewhat forward in the pulling head 100, thus increasing the grip length of a break stem. The elastic collet 102 also renders the pulling head 100 easy to assemble. The elastic collet 102 may be formed of, for example, Maraging C-300, heat treated to a hardness rating of 53-56 HRC.

Preferably, the elastic collet 102 includes six fingers 104, although a greater or lesser number of fingers can be provided while staying well within the scope of the present invention. A benefit to providing as many as six fingers is that by providing smaller arcs (i.e., six 60 degree arcs, rather than three 120 degree arcs), they are closer to being straight lines, resulting in six closely matched engagement sections of the jaw teeth with the corresponding serrations on the break stem.

As shown in FIG. 12, the pulling head 100 includes a sleeve 114 which is generally cylindrical and has a threaded bore 116 at one of its ends 118 for receiving a nosepiece 120 in a threaded engagement. A collet 122 is disposed in the sleeve 114, and the collet 122 is also generally cylindrical. The collet 122 includes an internally threaded portion 124 which is configured to engage a piston 126 of the riveter 128 in a threaded engagement.

Inside the collet 122 sits the elastic collet 102, and a back end 130 of the elastic collet 102 preferably contacts a bushing 132, which is preferably formed of polyurethane. The bushing 132 also contacts the piston 126 of the riveter 128 when the piston 126 is threadably engaged with the collet 122, as shown in FIG. 12. As such, the bushing 132 is located between the piston 126 and the elastic collet 102 and not only provides high and reliable push force, but also acts as a shock absorber during tool operation.

The back end 130 of the elastic collet 102 is shaped such that an exterior surface 134 of the elastic collet 102 contacts an interior surface 136 of the collet 122, thereby generally centering the elastic collet 102 in the collet 122. As such, the fingers 104 of the elastic collet 102 stay accurately centered and positioned in the pulling head 100, eliminating any possibility of jaw damage which would otherwise be caused by jaws tumbling, being off-center, or being otherwise positioned incorrectly. Preferably, the back end 130 of the elastic collet 102 provides a large transition radius 137 to avoid any stress concentration.

Proximate a front end 138 of the fingers 104 is an angled surface 140 which is configured to engage a corresponding angled surface 142 inside the collet 122. The bushing 132 tends to press the elastic collet 102 forward in the collet 122, such that the angled surfaces 140 of the fingers 104 engage the corresponding angled surface 142 inside the collet 122, thereby closing the jaw portion 106 of the fingers 104 on a break stem of a fastener, unless the collet 122 is not being pulled by the piston 126 of the riveter 128. A front, internal surface 144 of each of the fingers 104 provides a tapered surface 146 which is configured to contact a corresponding angled surface 148 on the end 150 of the nosepiece 120. As such, when the collet 122 is not being pulled by the piston 126 of the riveter 128, the bushing 132 tends to push the elastic collet 102 forward such that the tapered surface 146 of each of the fingers 104 contacts the corresponding angled surface 148 on the end 150 of the nosepiece 120, thereby opening the fingers 104 to accept insertion of a break stem before the riveter 128 is actuated.

Once the break stem has been inserted into the nosepiece 120, actuation of the riveter 128 causes the collet 122 to be pulled back in the pulling head 100, causing the angled surface 142 in the collet 122 to push the fingers 104 back out of engagement with the nosepiece 120, and causing the jaw area 106 of the fingers to grip and pull on the break stem of the fastener, until the fastener installs and the break stem breaks.

The elastic collet 102 is configured such that both the front and the back are guided inside of the collet 122, so the fingers 104 stay accurately centered and positioned eliminating any possibility of jaw damage caused by the jaws tumbling, being off-center, or otherwise being positioned incorrectly. The design also eliminates completely the possibility for an operator to cause jaw damage when placing the pulling head 100 onto the fastener to be installed.

The pulling head 100 shown in FIG. 12 also provides that the internal jaw portions 106 of the fingers 104 are positioned significantly closer to the fastener to be installed, than does the pulling head 10 shown in FIGS. 1 and 2, thereby providing for a longer engagement with the break stem of the fastener to be installed.

The pulling head 100 shown in FIG. 12 provides a larger number of teeth 108 in engagement with the break stem, a perfect matching of the teeth 108, precisely controlled jaw positioning with no possibility of misalignment, as many as six fingers 104 which provide optimum elasticity and load distribution, shock absorption, high mechanical properties of the materials used, reliability, high jaw life and increased stem engagement.

FIGS. 18-22 provide sequence views showing the pulling head being operated to install a blind bolt. Although FIGS. 18-22 depict a blind bolt being installed, the pulling head disclosed herein is able to install any blind fastener that works on the same "pull to install" principle. The jaws merely need to match or correspond to the serration pattern of the fastener to be installed.

Figure 18:
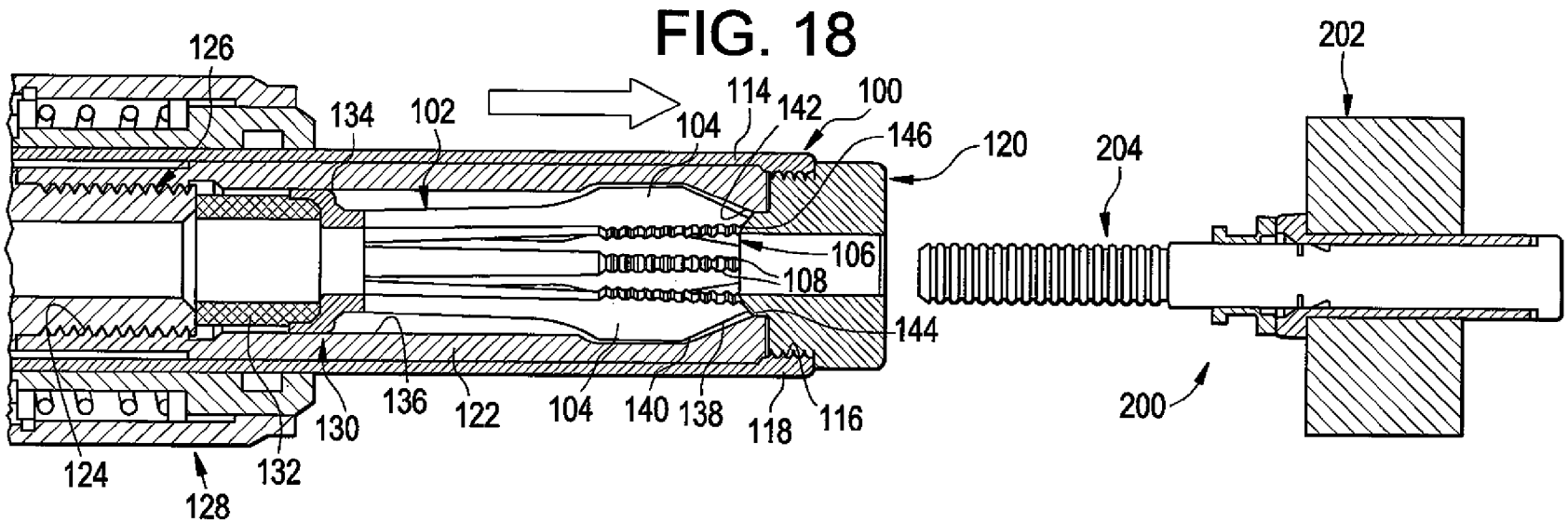
FIGS. 18-22 provide sequence views showing operation of the pulling head.
Figure 19:
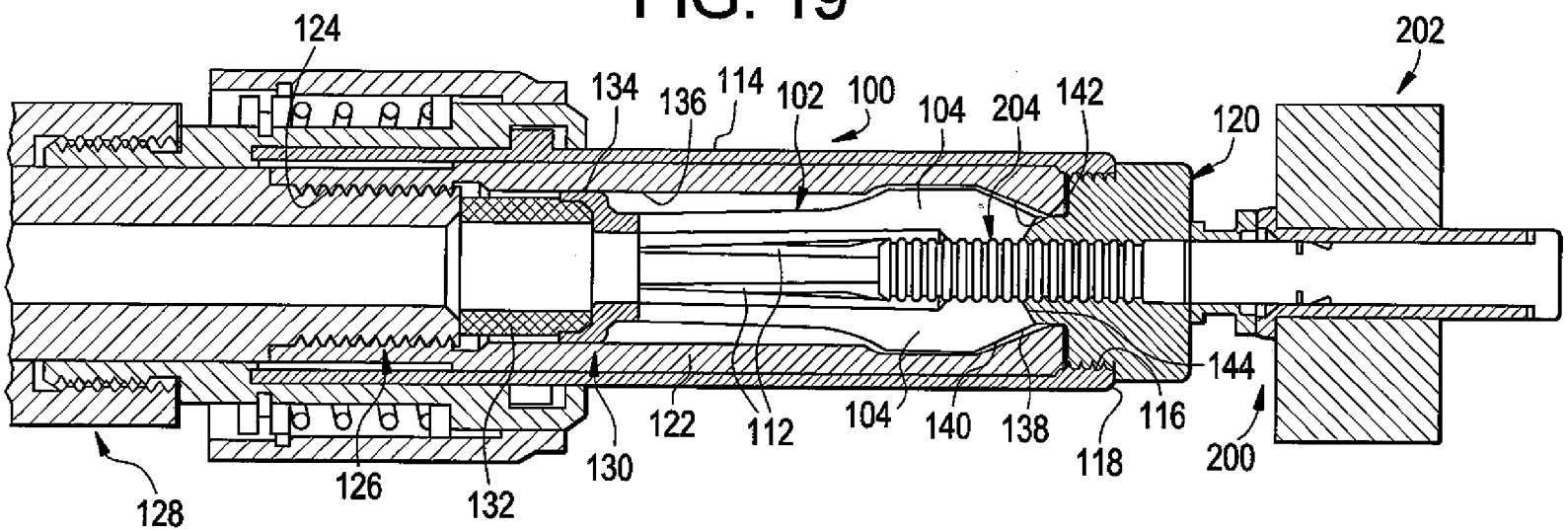
Figure 20:
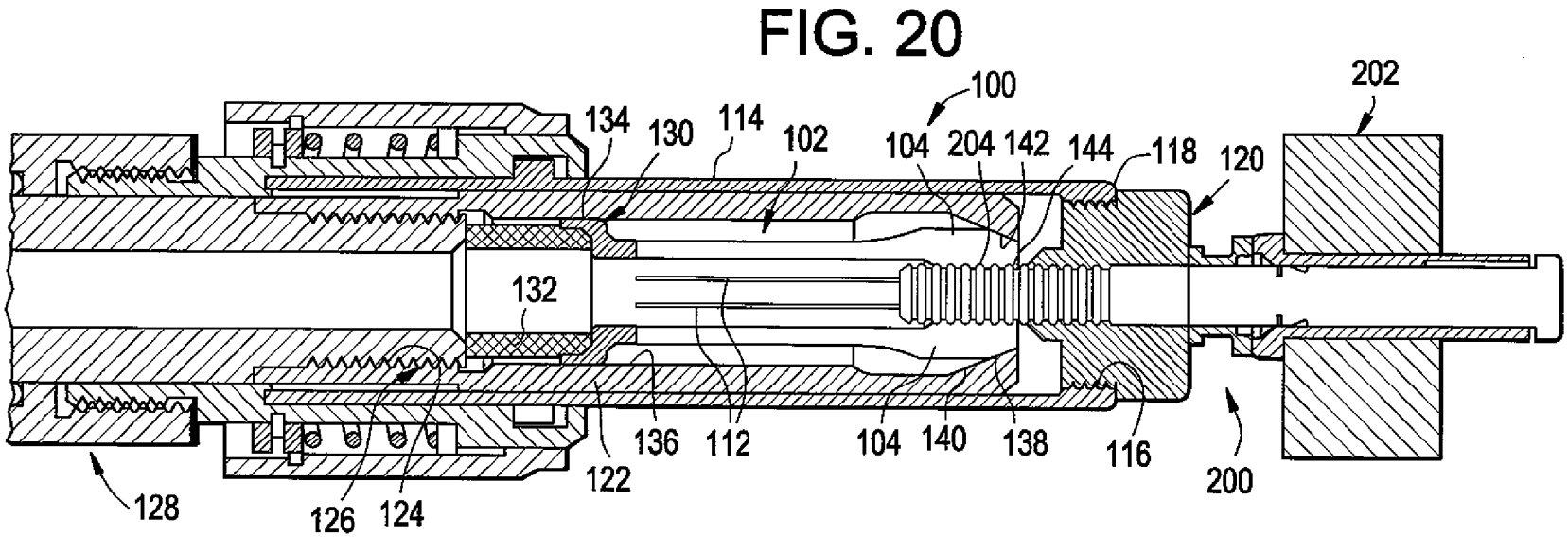
Figure 21:
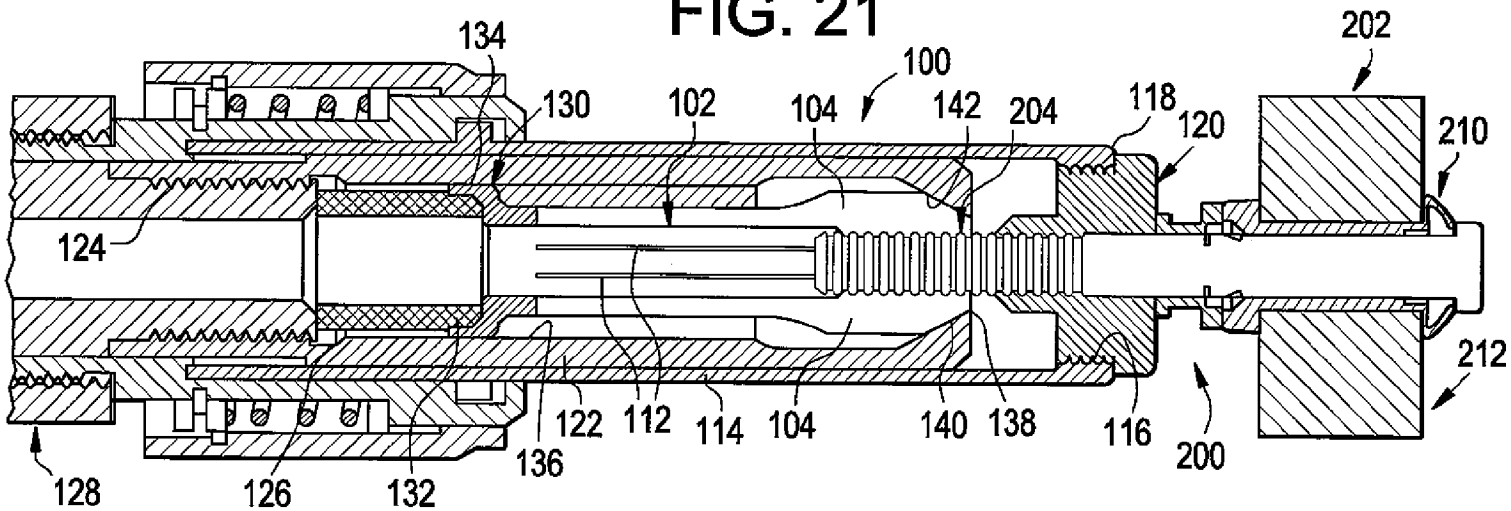
Figure 22:
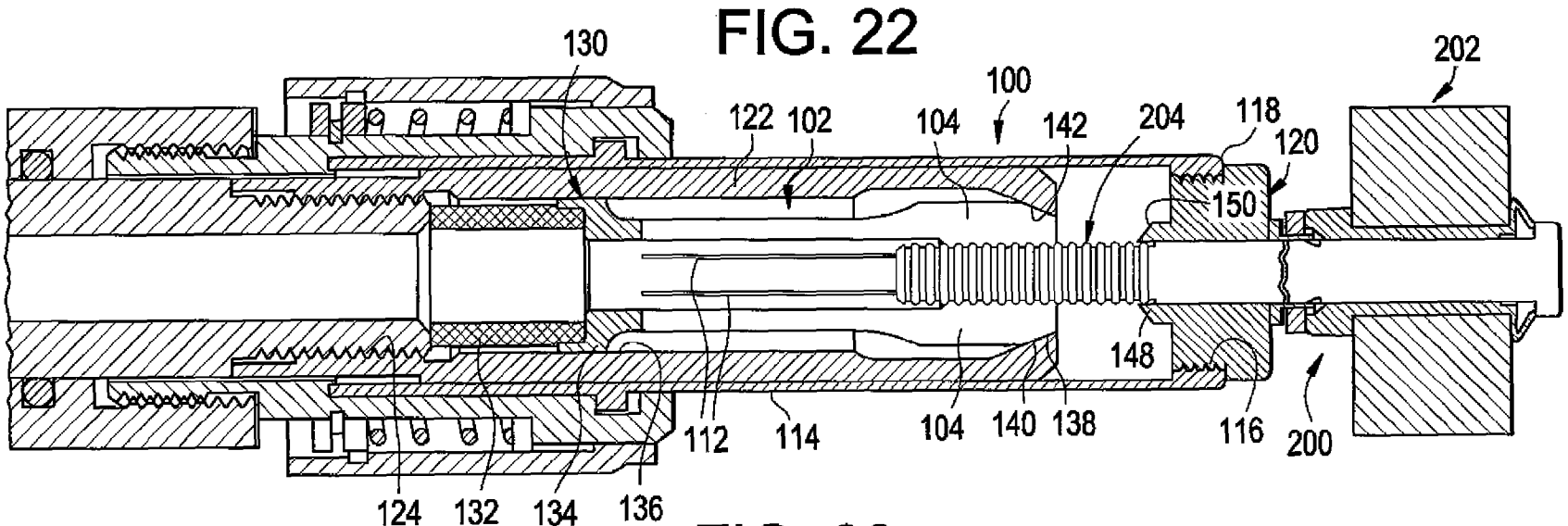

As shown in FIG. 18, with the elastic collet 102 open, the pulling head 100 approaches the fastener, such as a blind bolt 200, to be installed into the structure 202 until the stem 204 of the blind bolt 200 is in the pulling head 100, and the nosepiece 120 contacts the fastener 200. Then, the trigger of the riveter 206 is depressed, causing the elastic collet 102 to move from the position shown in FIG. 19 to the position shown in FIG. 20, and causing the jaws 106 of the collet 102 to close on the stem 204. The piston 208 of the riveter 206 moves backward, and as the piston 208 continues to move, the stem 204 is pulled toward the riveter 206, as shown in FIG. 21, causing a bulb 210 to form on the blind side 212 of the workpiece structure 202, thereby completing the first step of the installation process. As the piston 208 continues to move, the stem 204 breaks as shown in FIG. 22, and installation of the fastener 200 is complete.

The load required to install some blind fasteners is very high, generating a tremendous amount of shock at when the stem breaks. This shock transmits through the elastic collet 102 to the bushing 132, i.e., the polyurethane element, which acts as a shock absorber, protecting the collet 122 and elastic collet 102 from experiencing excess stresses.

Figure 15:
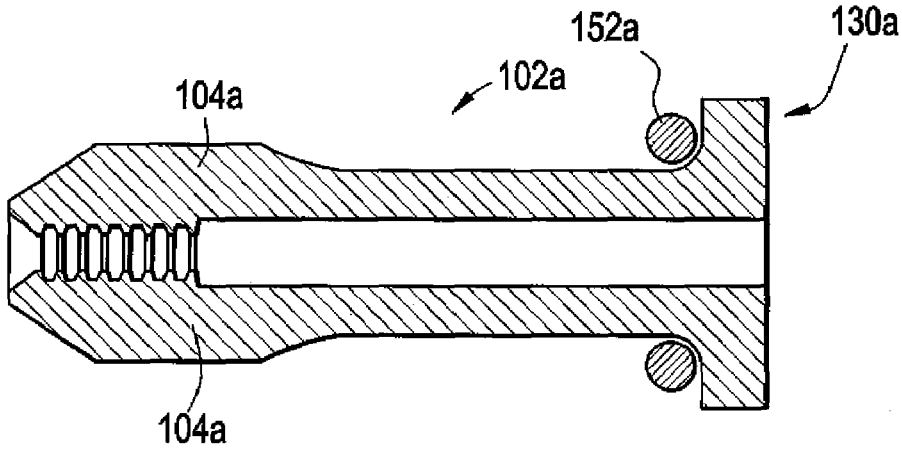
FIG. 15 is a cross-sectional view of an elastic collet which is in accordance with an alternative embodiment.
Figure 16:
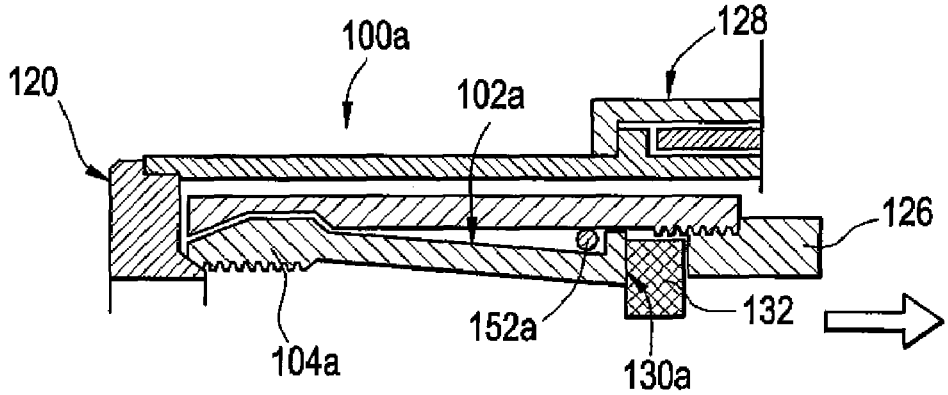
FIG. 16 is a cross-sectional view of a portion of a pulling head where the pulling head is in accordance with an alternative embodiment and includes the elastic collet shown in FIG. 15.
Figure 17:
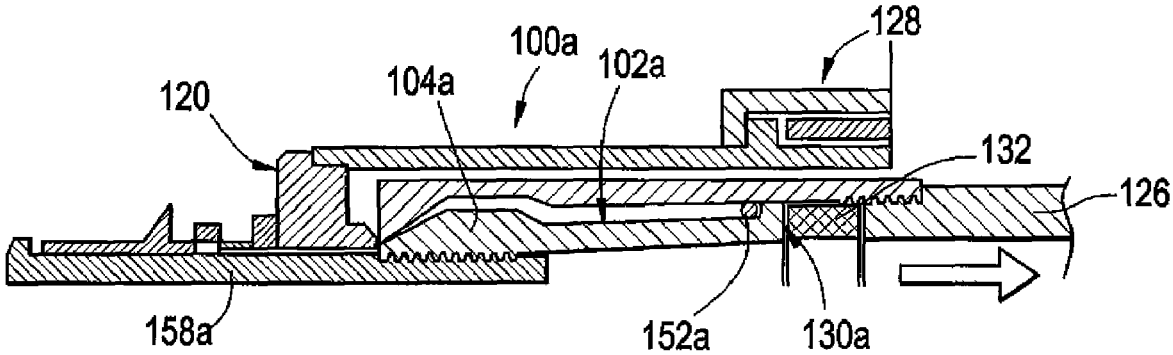
FIG. 17 is similar to FIG. 16, but shows the fingers of the elastic collet gripping a break stem.

FIG. 15 is a cross-sectional view of an elastic collet 102*a* which is in accordance with an alternative embodiment, while FIG. 16 is a cross-sectional view of a portion of a pulling head 100*a* where the pulling head 100*a* is in accordance with an alternative embodiment and includes the elastic collet 102*a* shown in FIG. 15. FIG. 17 is similar to FIG. 16, but shows the fingers 104*a* of the elastic collet 102*a* gripping a break stem 158*a*.

Figure 14:
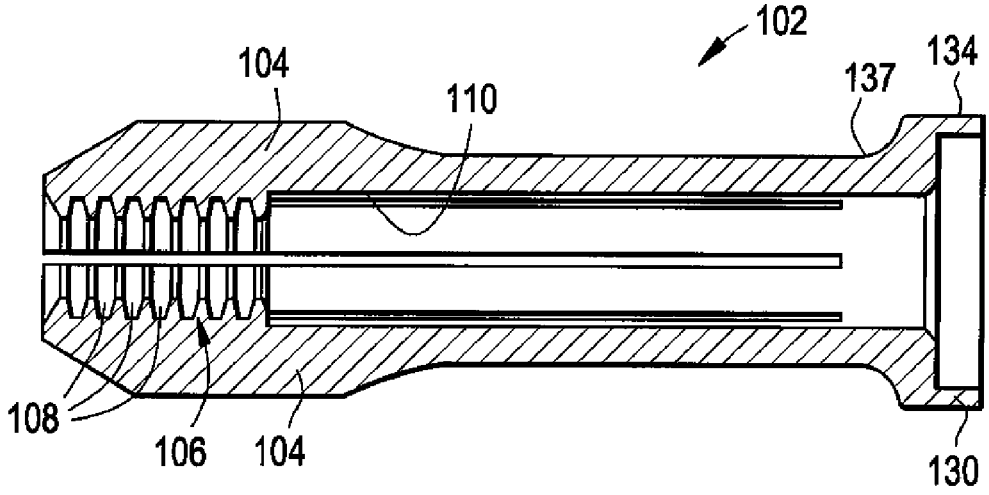
FIG. 14 is a cross-sectional view of the elastic collet, taken along line 5-5 of FIG. 13.

As shown in FIGS. 15-17, a back end 130*a* of the elastic collet 102*a* is shaped somewhat differently than the elastic collet 102 shown in FIGS. 12-14, and an elastic retaining member 152*a* is engaged around the outside surface of the fingers, proximate their back ends. Otherwise, the pulling head 100*a* shown in FIGS. 16 and 17 is generally similar to the pulling head 100 shown in FIG. 12 and operates in much the same maimer.

Figure 23:
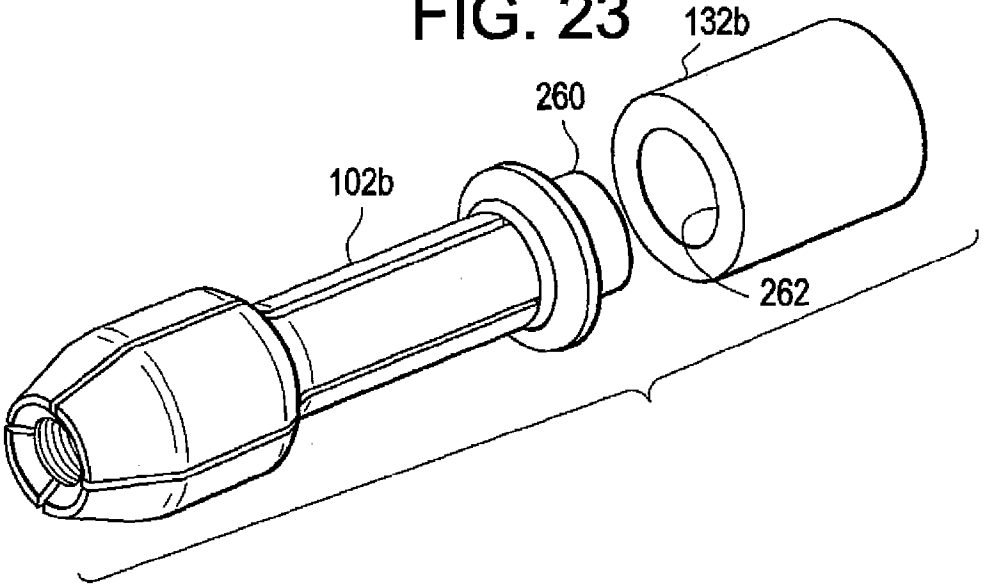
FIG. 23 is an exploded perspective view of an elastic collet and bushing, in accordance with an alternative embodiment of the present invention.

FIG. 23 illustrates an elastic collet 102*b* and bushing 132*b* which may be utilized instead of the elastic collet 102 and bushing 132 described hereinabove. As shown, the rear end 260 of the elastic collet 102*b* is configured such that the bushing 132*b* fits around it, with the end 260 of the elastic collet 102*b* being received in a throughbore 262 provided in the bushing 132*b*.

While specific embodiments of the invention are shown and described, it is envisioned that those skilled in the art may devise various modifications without departing from the spirit and scope of the foregoing description.

What is claimed is:

1. A pulling head which is configured for engagement with a piston of a riveter and configured to grip and pull a stem of a fastener, said pulling head comprising: a sleeve having an end; a nosepiece engaged with the end of the sleeve; a collet inside the sleeve and engageable with the piston; a plurality of jaws which are inside the collet and which are configured for engaging and pulling on the stem, wherein the jaws are arranged about a longitudinal axis, and each of the jaws has an angled surface which contacts an internal surface of the collet and which is at least forty-five degrees relative to the longitudinal axis about which the jaws are arranged.

2. A pulling head as recited in claim 1, wherein the angled surface of each of the jaws forms a sixty degree angle relative to the longitudinal axis about which the jaws are arranged.

3. A pulling head as recited in claim 1, further comprising a retaining member which contacts an external surface of the jaws and holds the jaws together.

4. A pulling head as recited in claim 3, wherein the retaining member which contacts the external surface of the jaws and holds the jaws together comprises an o-ring.

5. A pulling head as recited in claim 3, wherein the retaining member is disposed in a notch which is provided on the jaws.

6. A pulling head as recited in claim 1, wherein both the sleeve and the collet are generally cylindrical.

7. A pulling head as recited in claim 1, wherein the sleeve has a threaded bore for receiving the nosepiece in a threaded engagement.

8. A pulling head as recited in claim 1, wherein the collet includes an internally threaded portion which is configured to engage the piston of the riveter in a threaded engagement.

9. A pulling head as recited in claim 1, wherein each of the jaws has serrations which, in transverse cross-section, are comprised of two straight segments having a fillet therebetween.

10. A pulling head which is configured for engagement with a piston of a riveter and configured to grip and pull a stem of a fastener, said pulling head comprising: a sleeve having an end; a nosepiece which is engaged with the end of the sleeve; a first collet inside the sleeve; and a second, elastic collet inside the first collet, wherein the elastic collet has a plurality of fingers, between each of which is a slot, wherein each of the fingers has an internal surface having teeth thereon for gripping and pulling the stem.

11. A pulling head as recited in claim 10, further comprising a bushing, wherein a back end of the elastic collet non-threadably contacts the bushing inside the first collet such that the bushing separates the elastic collet form the piston.

12. A pulling head as recited in claim 11, wherein the bushing contacts the piston of the riveter when the piston is engaged with the first collet.

13. A pulling head as recited in claim 12, wherein the bushing is located between the piston of the riveter and the elastic collet.

14. A pulling head as recited in claim 10, wherein the fingers of the elastic collet are configured to open and close during operation, and are configured to grip the stem of the fastener during installation such that there is no side loading.

15. A pulling head as recited in claim 10, wherein both the sleeve and the collet are generally cylindrical.

16. A pulling head as recited in claim 10, wherein the sleeve has a threaded bore for receiving the nosepiece in a threaded engagement.

17. A pulling head as recited in claim 10, wherein the second collet includes an internally threaded portion which is configured to engage the piston of the riveter in a threaded engagement.

18. A pulling head as recited in claim 10, wherein the elastic collet comprises six fingers.

19. A pulling head as recited in claim 10, wherein a back end of the elastic collet is shaped such that an exterior surface of the elastic collet contacts an interior surface of the first collet, thereby centering the elastic collet in the first collet.

20. A pulling head as recited in claim 10, wherein a front end of the fingers provides an angled surface which is configured to engage a corresponding angled surface inside the first collet, wherein a front, internal surface of each of the fingers provides a tapered surface which is configured to contact a corresponding angled surface on the end of the nosepiece.

* * * * *